US008400310B2

(12) United States Patent
Brow

(10) Patent No.: US 8,400,310 B2
(45) Date of Patent: Mar. 19, 2013

(54) AUTOMATED HAND CLEANING REMINDER SYSTEM FOR AN ENTRANCEWAY

(76) Inventor: G. Raymond Brow, Charlottetown (CA)

( * ) Notice: Subject to any disclaimer, the term of this patent is extended or adjusted under 35 U.S.C. 154(b) by 322 days.

(21) Appl. No.: 12/794,616

(22) Filed: Jun. 4, 2010

(65) Prior Publication Data

US 2011/0025509 A1 Feb. 3, 2011

(30) Foreign Application Priority Data

Jun. 5, 2009 (CA) ..... 2668078

(51) Int. Cl.
*G08B 23/00* (2006.01)

(52) U.S. Cl. ..... 340/573.1; 340/539.12; 340/539.22; 340/541; 340/545.3; 340/565; 222/23; 222/39

(58) Field of Classification Search ..... 340/573.1, 340/572.1, 539.12, 539.22, 541, 545.3, 565; 222/39, 23

See application file for complete search history.

(56) References Cited

U.S. PATENT DOCUMENTS

| | | | | |
|---|---|---|---|---|
| 5,202,666 | A * | 4/1993 | Knippscheer | 340/573.1 |
| 5,812,059 | A * | 9/1998 | Shaw et al. | 340/573.1 |
| 5,945,910 | A * | 8/1999 | Gorra | 340/573.1 |
| 6,236,317 | B1 * | 5/2001 | Cohen et al. | 340/573.1 |
| 6,392,546 | B1 * | 5/2002 | Smith | 340/573.1 |
| 6,882,278 | B2 * | 4/2005 | Winings et al. | 340/573.1 |
| 6,975,231 | B2 * | 12/2005 | Lane et al. | 340/573.1 |
| 7,551,092 | B1 * | 6/2009 | Henry | 340/573.1 |
| 7,782,214 | B1 * | 8/2010 | Lynn | 340/573.1 |
| 7,825,812 | B2 * | 11/2010 | Ogrin et al. | 340/573.1 |
| 7,898,407 | B2 * | 3/2011 | Hufton et al. | 340/539.11 |
| 2006/0132316 | A1 * | 6/2006 | Wildman et al. | 340/573.1 |
| 2007/0257803 | A1 * | 11/2007 | Munro et al. | 340/573.1 |
| 2009/0224924 | A1 * | 9/2009 | Thorp | 340/573.1 |
| 2010/0134296 | A1 * | 6/2010 | Hwang | 340/573.1 |
| 2010/0164728 | A1 * | 7/2010 | Plost | 340/573.1 |

* cited by examiner

*Primary Examiner* — Albert Wong
*Assistant Examiner* — Peter Mehravar
(74) *Attorney, Agent, or Firm* — Mayback & Hoffman, P.A.; Gregory L. Mayback

(57) ABSTRACT

The present invention relates to an improved an automated hand cleaning reminder system having a disinfectant dispenser mounted proximate to an entranceway. When approaching the entranceway the visitor must first utilize a disinfectant dispenser to gain unalarmed entry or exit through the entranceway. When the disinfectant dispenser is utilized the disinfectant dispenser transmits a signal to a processor which then deactivates temporarily a motion/presence detector scanning an area immediately adjacent or close to the entranceway, and thus permits entry or exit for the visitor. At the same time, processor activates a light emitter to provide a visual indication to the visitor that passage is permitted, and, simultaneously also activates the access allowed audio tone to be played through a message conveying apparatus. If the dispenser has not been utilized, the proximity detector will remain armed and the processor then issues an access denied audio tone to be played through the message conveying apparatus, and, simultaneously also activates a flashing light emitter to provide a visual indication to the visitor that passage is not permitted.

10 Claims, 2 Drawing Sheets

AUTOMATED HAND CLEANING REMINDER SYSTEM FOR AN ENTRANCEWAY

CROSS-REFERENCE TO RELATED APPLICATION

This Application relates to and claims priority to Canadian Patent Application No. 2,668,078, filed Jun. 5, 2009, entitled AUTOMATED HAND WASHING REMINDER SYSTEM FOR AN ENTRANCEWAY, the entirety of which is incorporated herein by reference.

FIELD OF THE INVENTION

The present invention relates generally to an automated hand cleaning reminder system, and, more particularly, to an automated hand cleaning reminder system for an entranceway that reminds a person to wash their hands before entering or exiting such a facility, thereby reducing the spread of germs and contagions.

DESCRIPTION OF THE PRIOR ART

Many diseases, such as hepatitis, have been found to be transmittable due to a failure of people to wash their hands. In fact, certain public health laws require those in, for example, the food distribution field to wash their hands each time they exit these facilities before they resume their duties. In areas such as hospitals or labs, the spread of germs and contagions is a serious health concern. For this reason, many such facilities post visual signs which are intended to remind a person to wash their hands before entry/exit, but such signs can be easily ignored, and thus stronger warning systems are required if such spread of disease is to be checked or inhibited. While signs may be innocuous means of warning the public of the need to wash their hands, with a view to reducing the spread of germs and contagions, stronger warning means that provide audible or visual alerts should be used in certain public facilities to provide these reminders, such as for employees of a restaurant, hospitals, food processing or research facilities, or the like.

Accordingly, there is need for an automated hand cleaning reminder system that utilizes a soap/disinfectant dispenser, and which can provide audible or visual alerts for use in a facility, such as restaurants, hospitals, food processing or research facilities, or the like, for ensuring that persons entering or leaving such a facility must disinfect their hands. There is also a need for an automated hand cleaning reminder system that permits unalarmed entry/exit once the soap/disinfectant dispenser has been activated, with a view to reducing the spread of germs and contagions. To this end, the present invention effectively addresses this need.

SUMMARY OF THE INVENTION

A general object and advantage of the present invention is to provide an improved automated hand cleaning reminder system that utilizes a disinfectant dispenser, and which can provide audible or visual alerts for use in a facility, such as a hospital or lab, for ensuring that persons entering or leaving such a facility must disinfect their hands.

A still further object and advantage of the present invention is to provide an improved automated hand cleaning reminder system that permits unalarmed entry/exit once the disinfectant dispenser has been activated, with a view to reducing the spread of germs and contagions.

A still further object and advantage of the present invention is to provide an improved automated hand cleaning reminder system that issues an audio message when the supply of soap/disinfectant in the disinfectant dispenser is running low, or when a battery powered power source is utilized and power is low.

According to one aspect of the present invention, there is provided an automated hand cleaning reminder system comprising product dispensing means mounted proximate an entranceway; a motion/presence detector being mounted in the product dispensing means and being adapted for detecting an approach of a visitor to the entranceway; a processor mounted in the product dispensing means and being electrically coupled to the motion/presence detector and in electronic communication with the product dispensing means; message conveying means mounted in the product dispensing means and being electrically coupled to the processor, the message conveying means providing an access allowed audio tone when a person has utilized the product dispensing means and issuing an access denied audio tone when a person has not utilized the product dispensing means, said processor being adapted for playing either the access allowed audio tone or the access denied audio tone on the message conveying means instantaneously after the motion/presence detector has detected the approach of the visitor to the entranceway; and a data storage device mounted in the product dispensing means and being electrically coupled to the processor.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
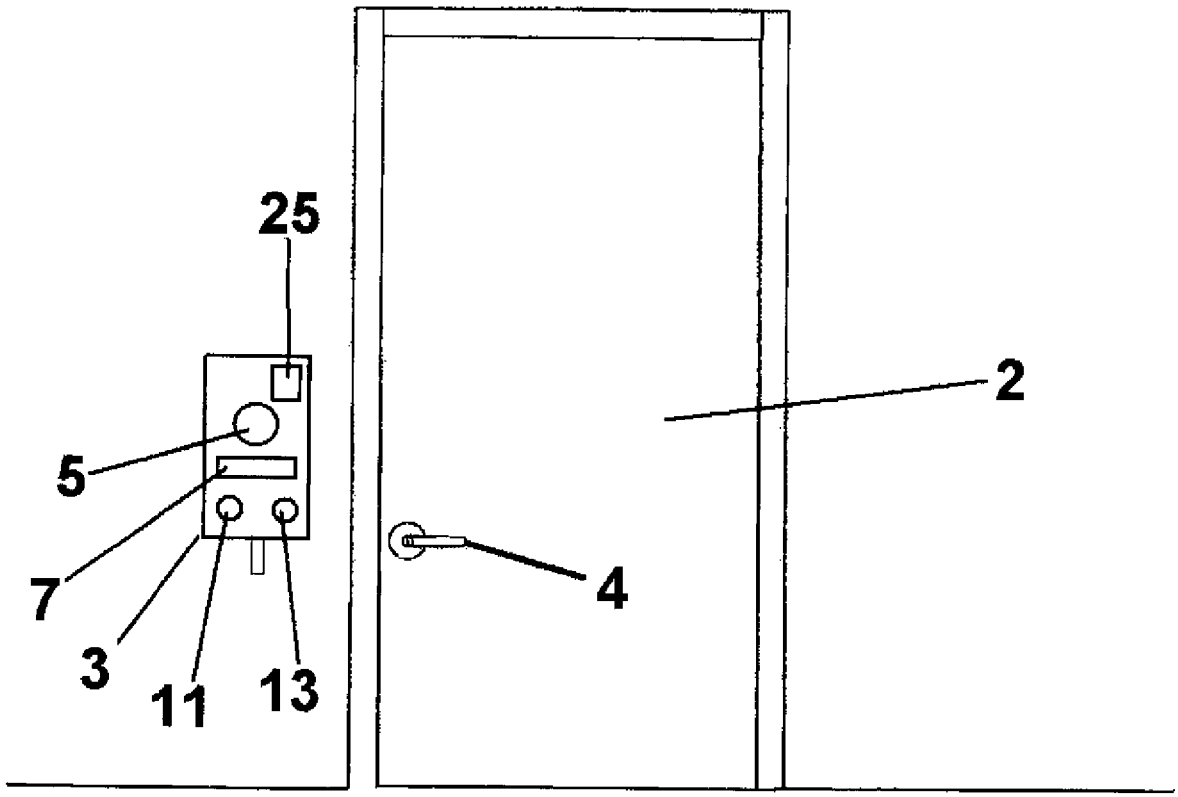
FIG. 1 illustrates a front view of the automated hand cleaning reminder system of the present invention.
Figure 2:
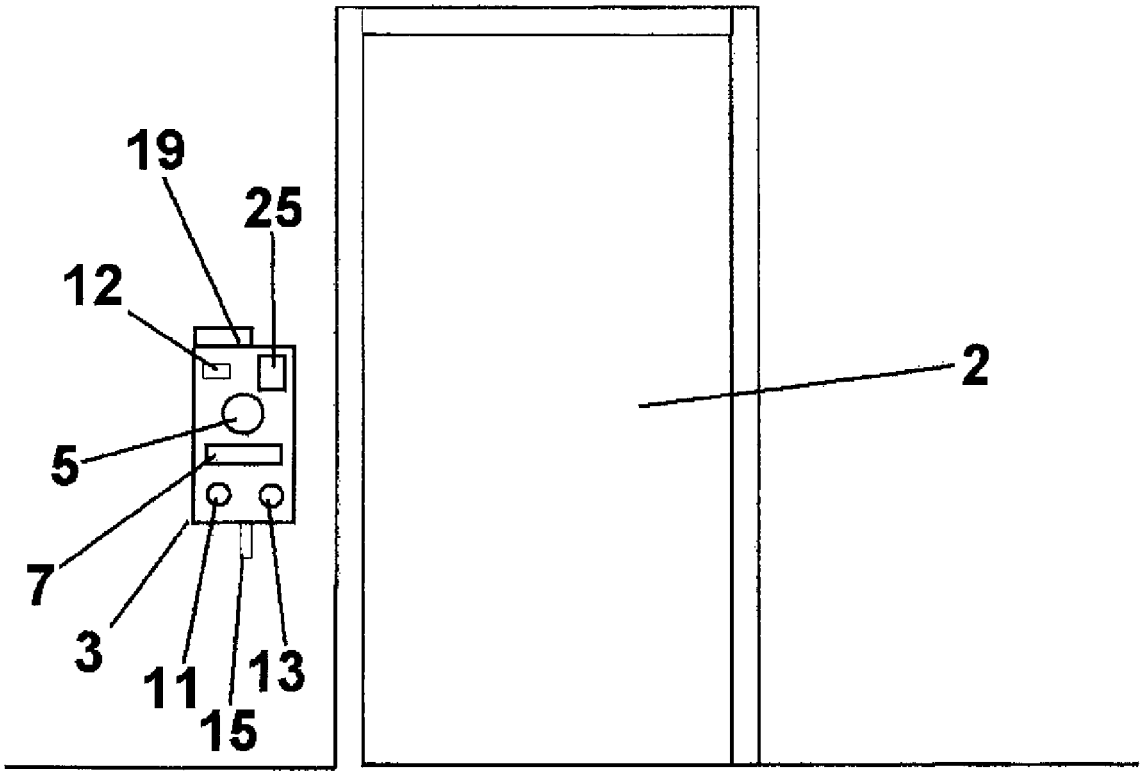
FIG. 2 illustrates a front view of another embodiment of the automated hand cleaning reminder system of the present invention, illustrating a door-less entranceway.

With reference now to the drawings, and in particular to FIGS. 1 and 2, the automated hand cleaning reminder system of the present invention, generally designated by the reference numeral 1, will now be described. In one embodiment, the system is electrically coupled to a primary power supply (not shown), preferably by hardwiring an electrical supply to components of the system. In an alternative embodiment, an alternate power source, such as battery power, could also be utilized. The automated hand cleaning reminder system 1 generally comprises a disinfectant dispenser 3 that is mounted proximate to an entranceway 2 to a facility, such as restaurants, hospitals, food processing or research facilities, or the like. In the preferred embodiment, the disinfectant dispenser 3 is mounted on a wall proximate and adjacent to the entranceway 2, though it will be readily understood that variations as to the placement of the housing are possible, as would be readily understood by one skilled in the art. For example, the disinfectant dispenser 3 could be mounted on another component, such as a tower, in close proximity to the entranceway 2. It will also be understood that disinfectant dispenser 3 is, preferably, arranged to be mounted on the outside or inside of a building, near an exterior doorway, or located inside the building's vestibule, and that a second, or indeed a plurality of disinfectant dispensers may be utilized to compel hand sanitization prior to exit or entry.

A motion/presence detector 5 is mounted on the disinfectant dispenser 3 and is adapted for detecting an approach of a visitor to the entranceway 2, it being understood that the motion/presence detector 5 can be conventional in nature. It will also be understood that a proximity detector could also be utilized, if desired. In a preferred embodiment, a processor 7 is housed within (or on) the disinfectant dispenser 3 it being understood that the processor 7 is electrically coupled to other components of the system that reside within the disinfectant dispenser 3, such as the motion/presence detector 5, message conveying apparatus 25, access allowed emitter 11, data storage device (not shown) and access denied emitter 13, as hereinafter described.

The data storage device 12 is mounted in the disinfectant dispenser 3, and preferably has recorded thereon a message indicating warnings such as a low supply warnings, it being understood that variations to the type of information collected and stored by the data storage device 12 are possible. Examples of such information that could be collected and stored in the data storage device could include number of people entering and exiting the building, the number of people and/or percentage of people who used the disinfectant dispenser 3, and malfunction alerts. In an alternative embodiment, the data storage device can also store a "low battery" warning, that can be issued through the message conveying apparatus 25, when a battery powered power source is utilized and power is low.

In operation, when approaching the entranceway 2 to facility, in a preferred embodiment, the visitor must first utilize disinfectant dispenser 3 by means of disinfectant dispensed from spout 15 to gain unalarmed entry to or exit from the facility through the entranceway 2. When the disinfectant dispenser 3 is utilized by the visitor in such a manner before approaching the entranceway 2, the disinfectant dispenser 3 transmits a signal to a processor 7, which then deactivates temporarily the motion/presence detector 5 scanning an area immediately adjacent or close to the entranceway 2, and thus permits entry or exit for the visitor. At the same time, processor 7 activates access allowed emitter 11 to provide a visual indication to the visitor that passage is permitted, and, simultaneously also activates an access allowed audio tone to be played through message conveying apparatus 25.

However, it will be understood that if the disinfectant dispenser 3 has not been utilized, and no signal from the disinfectant dispenser 3 has been transmitted to the processor 7, the motion/presence detector 5 will remain in an armed position. In this scenario, if the visitor approaches the entranceway 2 without utilizing the disinfectant dispenser 3, the motion/presence detector 5 indicates the presence of the visitor to the processor 7, which then issues the access denied audio tone to be played through message conveying apparatus 25, and, simultaneously also activates the access denied emitter 13 to provide a visual indication to the visitor that passage is not permitted. To gain entry, as noted above, the visitor utilizes the disinfectant dispenser 3 before entering the entranceway 2, and the signal emitter (not shown) from the disinfectant dispenser 3 transmits a signal to a processor 7, which then deactivates temporarily the motion/presence detector 5 scanning an area immediately adjacent or close to the entranceway 2, and thus permits entry or exit for the visitor. At the same time, processor 7 activates access allowed emitter 11 to provide a visual indication to the visitor that passage is permitted, and, simultaneously also activates the access allowed audio tone to be played through message conveying apparatus 25. In one embodiment, the visual indication that is given to the visitor to indicate that passage is permitted can be a signal, visual or otherwise, (such as a "green" light), and the visual indication that is given to the visitor to indicate that passage is not permitted is another form of signal (such as, for example only, a "red light"), though it will, of course, be understood that numerous variations as to this can be effected. As seen in FIG. 1, the visitor could utilize handle 4 on the door to gain entry or exit, or, alternatively, as shown in FIG. 2, the entranceway 2 could contain no door at all.

It will be appreciated by those skilled in the art that the processor 7 is, preferably, in electronic communication with the disinfectant dispenser 3 and can communicate with the disinfectant dispenser 3 through electro magnetic signals, or a combination thereof, as is conventionally known. It will also be appreciated by those skilled in the art that the electro magnetic signals can include infra-red, RF, or any other electro magnetic signal, as are well known in the art. Alternatively, the connection between these components could also be hard wired.

In a further embodiment, the processor 7 may also issue an audible message to individuals who are attempting to enter (or exit), and who have not utilized the disinfectant dispenser 3, through the playing of a recorded audio message or reminder (such as, "Soap and Rinse your hands" or "please sanitize your hands to gain entry to this building") through a message conveying apparatus 25, it being understood that variations as to the type of message conveyed are possible. In this embodiment, the audible message is activated when the visitor has attempted to gain entry/exit by passing through the entranceway 2, and the processor 7 recognizes that no signal from the disinfectant dispenser 3 has been transmitted to the processor 7, at which point the processor 7 issues a signal to the message conveying apparatus 25 to issue the recorded access denied audio tone to the visitor. It will, of course, be understood that multiple such reminders could be effected, if the processor is so programmed. It will also be understood that either of the access allowed signal and access denied signal can be displayed substantially simultaneously with an issuance of a respective one of the access allowed audio tone and the access denied audio tone.

It will also be understood that such reminder messages can also be conveyed in the form of a visual reminder, such as through use of an LED sign (not shown), or other types of sounds that are emitted for the user to hear, it being understood that variations to these conveyed messages are possible, such as MP3's for example.

In a still further embodiment, when supplies are low in the disinfectant dispenser 3, the signal emitter (not shown) from the soap/disinfectant dispenser 3 transmits a signal to the processor 7 to activate the low supply (or low soap) warning to be played through message conveying apparatus 25. In much the same manner, when battery power for the system is low, the processor 7 activates the low battery warning to be played through message conveying apparatus 25 when this occurs.

In a further embodiment of the present invention, and with reference to FIG. 2, the disinfectant dispenser 3 will be web enabled, by way of web enabled circuit 19, either physically or wirelessly, through conventional means (such as wireless connection) commonly known and readily available in the art. In this manner, actions, settings and events for the disinfectant dispenser 3 can be observed or changed manually on site or remotely such as via the internet by a remote operator. Preferably, in effecting this embodiment, web enabled circuit 19 will have access to information stored in the data storage device 8 by means of processor 7, whereby events and information regarding the disinfectant dispenser 3 contained in data storage device 8 can be accessed via the internet, through the web enabled circuit, by a remote operator.

Further, by way of web enabled circuit 19, actions, settings or overview of the disinfectant dispenser 3 can be observed or changed via the internet by a remote operator. It will also be understood that these can also be changed manually on site by the operator. Preferably, the disinfectant dispenser 3 itself will have its own web address, through which an operator will have security access to access any collected data from the data storage device 8, or voice recording changes, through conventional means (such as wireless connection) commonly known and readily available in the art.

In a further embodiment, the present invention may be equipped with an anti-vandalism feature (not shown) which is embedded in the disinfectant dispenser, and which sends out a distress signal, via the microprocessor, through wireless transmission or through other means previously described herein, to a remote operator advising of the situation.

In a still further embodiment of the present invention, the disinfectant dispenser 3 can be configured for radio-frequency identification (RFID), or card reader information, whereby a visitor approaching the doorway could utilize a tag card, or swipe card, to temporarily deactivate the motion/presence detector 5 scanning an area immediately adjacent or close to the entranceway 2, and thus permits entry or exit for the visitor.

The present invention has been described herein with regard to preferred embodiments. However, it will be obvious to persons skilled in the art that a number of variations and modifications can be made without departing from the scope of the invention as described herein.

The embodiments of the invention in which an exclusive property or privilege is claimed are defined as follows:

1. An automated hand cleaning reminder system comprising:

product dispensing means mounted proximate an entranceway;

a motion/presence detector being mounted in the product dispensing means and being adapted for detecting an approach of a visitor to the entranceway;

a processor mounted in the product dispensing means and being electrically coupled to the motion/presence detector and in electronic communication with the product dispensing means;

message conveying means mounted in the product dispensing means and being electrically coupled to the processor, the message conveying means providing an access allowed audio tone when a person has utilized the product dispensing means and issuing an access denied audio tone when a person has not utilized the product dispensing means, said processor being adapted for playing either the access allowed audio tone or the access denied audio tone on the message conveying means instantaneously after the motion/presence detector has detected the approach of the visitor to the entranceway;

a data storage device mounted in the product dispensing means and being electrically coupled to the processor;

a web enabled circuit in electronic communication with the data storage device, the processor and the Internet, and wherein the product dispensing means has an internet web address, whereby low supply warnings/low battery warnings, settings and events for the product dispensing means can be retrieved from the data storage device and observed or changed on site, via the internet web address or via the Internet by a remote attendant; and wherein the processor temporarily deactivates the motion/presence detector when the person has utilized the product dispensing means to permit entry by the person.

2. The system of claim 1, wherein the access allowed audio tone and the access denied audio tone are recorded on the data storage device.

3. The system of claim 1, wherein the system is constructed and arranged for connection to a power source.

4. The system of claim 1, wherein the processor is adapted for displaying an access allowed signal on the message conveying means to provide a visual indication to the visitor that passage is permitted or an access denied signal on the message conveying means to provide a visual indication to the visitor that passage is not permitted.

5. The system of claim 4, wherein either of the access allowed signal and access denied signal are displayed substantially simultaneously with an issuance of a respective one of the access allowed audio tone and the access denied audio tone.

6. The system of claim 5, wherein the access allowed signal is a green light and the access denied signal is a red light.

7. The system of claim 1, wherein the product dispensing means, when a supply of product in the product dispensing means is low, is constructed and arranged to transmit a low supply warning to the processor to be conveyed through the message conveying means.

8. The system of claim 1, wherein the product dispensing means is mounted adjacent to the doorway.

9. The system of claim 1, wherein the product dispensing means is mounted on an outside or inside of a building containing the doorway.

10. The system of claim 1, further comprising a plurality of product dispensing means.

* * * * *